US008493373B2

(12) United States Patent
Jeon et al.

(10) Patent No.: US 8,493,373 B2
(45) Date of Patent: Jul. 23, 2013

(54) DISPLAY DRIVING SYSTEM WITH MONITORING UNIT FOR DATA DRIVER

(75) Inventors: Hyun-Kyu Jeon, Daejeon-si (KR); Yong-Hwan Moon, Incheon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 595 days.

(21) Appl. No.: 12/715,074

(22) Filed: Mar. 1, 2010

(65) Prior Publication Data

US 2010/0225637 A1 Sep. 9, 2010

(30) Foreign Application Priority Data

Mar. 4, 2009 (KR) ..... 10-2009-0018506

(51) Int. Cl.
*G09G 5/00* (2006.01)

(52) U.S. Cl.
USPC ..... 345/204; 345/213; 345/99; 345/100

(58) Field of Classification Search
USPC ..... 345/77–104, 204–210, 213, 690–694; 377/64–81
See application file for complete search history.

(56) References Cited

U.S. PATENT DOCUMENTS

| | | | | |
|---|---|---|---|---|
| 6,995,519 | B2 * | 2/2006 | Arnold et al. | 315/169.3 |
| 7,212,186 | B2 * | 5/2007 | Harano | 345/99 |
| 7,724,225 | B2 * | 5/2010 | Yi | 345/89 |
| 7,847,779 | B2 * | 12/2010 | Liao | 345/99 |
| 8,134,550 | B2 * | 3/2012 | Kim et al. | 345/213 |
| 2003/0160753 | A1 * | 8/2003 | McCartney | 345/99 |
| 2004/0061675 | A1 * | 4/2004 | Hirakawa et al. | 345/88 |
| 2004/0227716 | A1 * | 11/2004 | Lin | 345/99 |
| 2005/0007359 | A1 * | 1/2005 | Iseki et al. | 345/204 |
| 2006/0202936 | A1 | 9/2006 | Chen et al. | |
| 2009/0153541 | A1 * | 6/2009 | Yusa | 345/213 |
| 2010/0033453 | A1 * | 2/2010 | Park et al. | 345/204 |
| 2010/0141636 | A1 * | 6/2010 | Marsanne et al. | 345/213 |
| 2010/0149083 | A1 * | 6/2010 | Park et al. | 345/99 |
| 2010/0156879 | A1 * | 6/2010 | Hong et al. | 345/213 |
| 2010/0156885 | A1 * | 6/2010 | Cho et al. | 345/214 |
| 2010/0225637 | A1 * | 9/2010 | Jeon et al. | 345/213 |
| 2011/0043493 | A1 * | 2/2011 | Chen | 345/204 |

FOREIGN PATENT DOCUMENTS

| | | |
|---|---|---|
| CN | 1536544 | 10/2004 |
| CN | 101286287 | 10/2008 |
| JP | 06-063139 | 3/1994 |
| JP | 6-63139 | 3/1994 |
| JP | 6-130919 | 5/1994 |
| JP | 11-338412 | 12/1999 |
| JP | 2000-66654 | 3/2000 |
| JP | 2006-184654 | 7/2006 |
| JP | 2007-511011 | 4/2007 |

(Continued)

*Primary Examiner* — Tom Sheng
(74) *Attorney, Agent, or Firm* — Kile Park Reed & Houtteman PLLC

(57) ABSTRACT

A display driving system includes a timing controller configured to receive a data signal composed of image data and generate a control signal such as a clock signal; an interface configured to transmit the data signal and the control signal to a plurality of data drivers; the data drivers configured to receive the data signal and the control signal through the interface and supply received signals to a display panel to display an image; and a monitoring unit configured to feed back LOCK signals indicative of state information of the data drivers to the timing controller such that the data drivers can be monitored.

14 Claims, 6 Drawing Sheets

FOREIGN PATENT DOCUMENTS

| | | |
|---|---|---|
| JP | 2010-107933 | 5/2010 |
| KR | 1020080102492 | 10/2008 |
| KR | 10-0883778 | 2/2009 |
| WO | 2005/050448 | 6/2005 |

* cited by examiner

DISPLAY DRIVING SYSTEM WITH MONITORING UNIT FOR DATA DRIVER

FIELD OF THE INVENTION

The present invention relates to a display driving system, and more particularly, to a display driving system with a unit for monitoring data drivers, which can monitor changes in the states of data drivers while a timing controller processes a clock signal and a data signal transmitted through an interface and supplies processed signals to a display panel, such that the state information of the data drivers can be fed back to the timing controller.

DESCRIPTION OF THE RELATED ART

In general, a display driving system includes a timing controller configured to process a data signal and generate and supply a clock signal and a timing control signal so as to drive a display panel, and data drivers (data driver ICs) configured to drive the display panel using the image data and the timing control signal transmitted from the timing controller.

Interfaces for transmitting the image data to be displayed between the timing controller and the data drivers include a multi-drop transmission type interface in which the data drivers share a data signal line and a clock signal line, a PPDS (point-to-point differential signaling) transmission type interface in which data signals are separately supplied to the respective data drivers and a clock signal is shared by the data drivers, and an interface in which a data signal and a clock signal are distinguished by multiple levels and a data differential signal embedded with the clock signal is transmitted to the data drivers through respective independent signal lines.

However, in the conventional display driving system, the timing controller consistently transmits the data signal and the control signal to the data drivers irrespective of the states of the data drivers.

Therefore, even when the data drivers are placed in abnormal states due to electromagnetic interference (EMI) caused during high speed data transmission or noise, since the timing controller consistently transmits the data signal and the control signal to the data drivers cannot properly recognize the states of the data drivers, a problem is caused in that appropriate measures cannot be taken.

SUMMARY OF THE INVENTION

Accordingly, the present invention has been made in an effort to solve the problems occurring in the related art, and an object of the present invention is to provide a display driving system with a unit for monitoring data drivers, which has a unit capable of feeding back a control signal indicative of states of data drivers to a timing controller such that the timing controller having recognized the states of the data drivers can transmit a data signal and a control signal appropriate for normalizing a data driver operating in an abnormal state so that the data driver can be quickly recovered to a normal operation.

In order to achieve the above object, according to one aspect of the present invention, there is provided a display driving system comprising a timing controller configured to receive a data signal composed of image data and generate a control signal such as a clock signal; an interface configured to transmit the data signal and the control signal to a plurality of data drivers; the data drivers configured to receive the data signal and the control signal through the interface and supply received signals to a display panel to display an image; and a monitoring unit configured to feed back LOCK signals indicative of state information of the data drivers to the timing controller such that the data drivers can be monitored.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
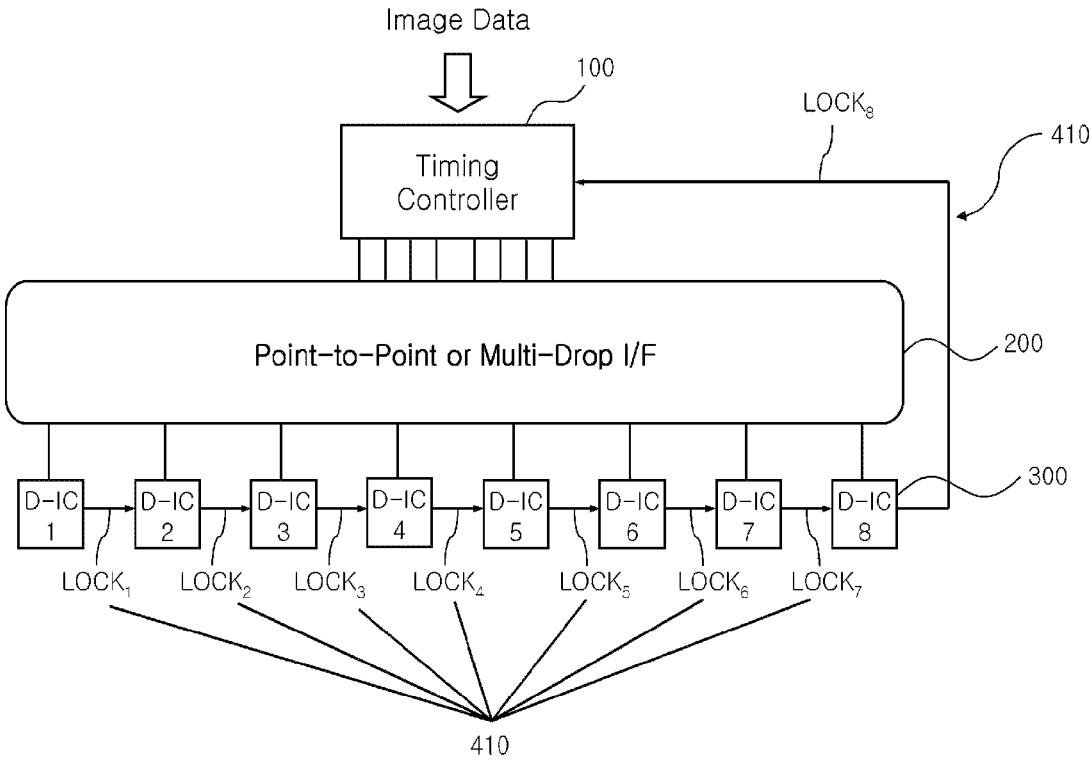
FIG. 1 is a block diagram illustrating a display driving system with a unit for monitoring data drivers in accordance with a first embodiment of the present invention.

Reference will now be made in greater detail to preferred embodiments of the invention, examples of which are illustrated in the accompanying drawings. Wherever possible, the same reference numerals will be used throughout the drawings and the description to refer to the same or like parts.

A display driving system with a unit for monitoring data drivers according to the present invention includes a timing controller 100 configured to receive a data signal composed of image data and generate and transmit a control signal such as a clock signal and so forth, an interface 200 configured to transmit the data signal and the control signal to a plurality of data drivers, the plurality of data drivers 300 configured to receive the data signal and the control signal from the interface 200, supply the received signals to a display panel to display an image and output LOCK signals indicative of the state information thereof, and a monitoring unit configured to feed back the state information of the data drivers 300 to the timing controller 100 so that the data drivers 300 can be monitored. The data drivers 300 inactivate and output the LOCK signal when they are in an abnormal state. The timing controller 100 receives the inactivated LOCK signal from the monitoring unit and can monitor the states of the data drivers 300.

The interface (I/F) 200 comprises a conventional interface which transmits the data signal and the control signal from the timing controller 100 to the data drivers 300. Examples of the interface 200 may include a multi-drop transmission type interface in which data drivers share a data signal line and a clock signal line, a PPDS (point-to-point differential signaling) transmission type interface in which data signals are separately supplied to respective data drivers and a clock signal is shared by the data drivers, and an interface in which data signals having a clock signal embedded therein are transmitted to data drivers through respective independent signal lines.

The interface 200 may comprise a novel interface which is disclosed in Korean Patent Application No. 10-2008-0102492 by the present applicant and in which data and clock signals are transmitted using a single level signal in which a clock signal is embedded between data signals at the same level so that a receiver can recover the data and clock signals during a clock training interval.

The monitoring unit can comprise various units which are connected between the data drivers 300 and the timing controller 100 and can feed back the state information of the data drivers 300. It is to be noted that the configuration of the monitoring unit is not limited to those of first through fifth embodiments of the present invention which will be described below with reference to FIGS. 1 through 6.

In this way, by continuously monitoring changes in the states of the data drivers 300 through the monitoring unit, if at least one of the data drivers 300 is in an abnormal state, the timing controller 100 transmits appropriate data signal and control signal so that the data driver 300 in the abnormal state can be quickly recovered to a normal state. The data driver 300 can neglect the signals inputted through the interface 200 until it is recovered to the normal state or can receive an appropriate signal which is helpful to the recovery of the data driver 300 to the normal state.

Of course, the monitoring unit is not limited to a specified type of interface and can be applied irrespective of the specification of an interface. Accordingly, while specified interfaces will be described below, it is to be appreciated that the interface 200 according to the present invention is not limited to such interfaces and can be configured in a variety of ways.

FIG. 1 is a block diagram illustrating a display driving system with a unit for monitoring data drivers in accordance with a first embodiment of the present invention. While it will be described with reference to FIG. 1 that an interface is configured such that transmission data in which a clock signal is embedded between data signals at a single level is transmitted through a single signal line, it is to be noted that the present invention is not limited to such an interface.

Referring to FIG. 1, a display driving system with a unit for monitoring data drivers in accordance with a first embodiment of the present invention includes a timing controller 100 configured to transmit transmission data, in which a clock signal is embedded between data signals at a single level, and a control signal, an interface 200 configured to transmit the data signals having the clock signal embedded therebetween to a plurality of data drivers, the data drivers 300 configured to receive the transmission data, recover the clock signal, supply the data signals to a display panel to display an image, and a monitoring unit configured to feed back the state information of the data drivers 300 to the timing controller 100 so that the data drivers 300 can be monitored.

The transmission data transmitted from the timing controller 100 is a signal in which the clock signal is embedded between the data signals at the same level. The interface 200 does not have a separate signal line for transmitting the clock signal, and transmits only a CED (clock embedded data) signal, in which the clock signal is embedded between the data signals at the same level, to the data drivers 300 using the single signal line. The CED signal can comprise not only a differential signal but also a single-ended signal.

Figure 2:
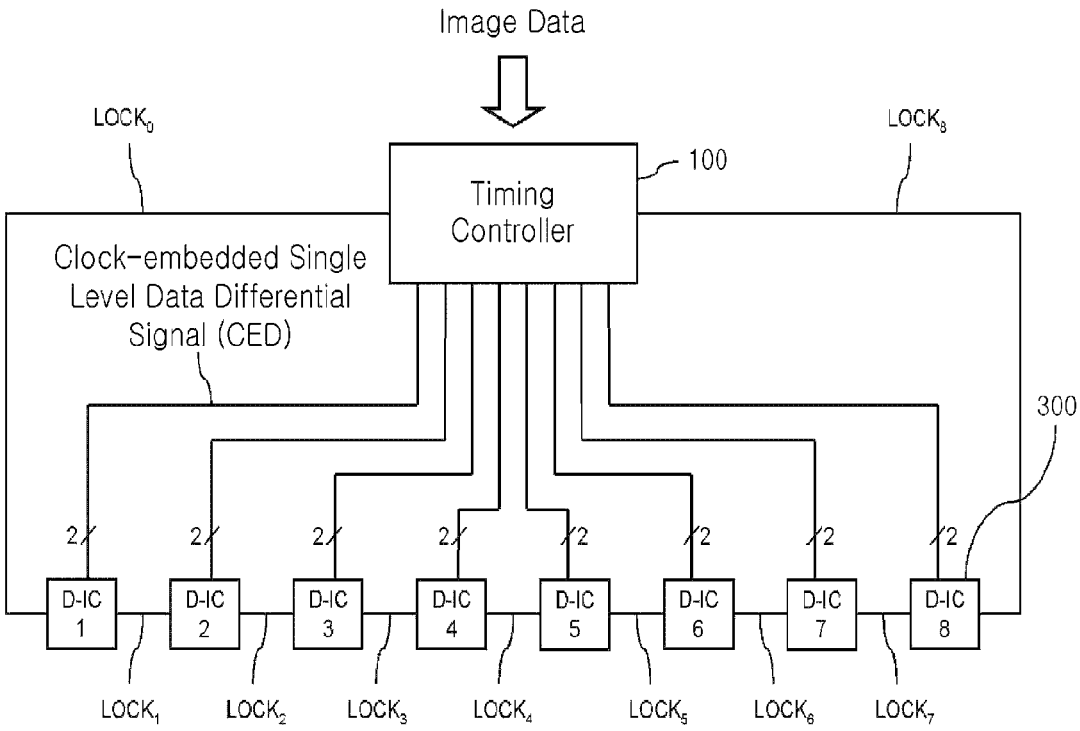
FIG. 2 is a block diagram illustrating a state in which transmission data composed of data signals with a clock signal embedded at a single level therein is transmitted through each single signal line according to the first embodiment of the present invention.

FIG. 2 is a block diagram schematically illustrating a state in which the transmission data composed of the data signals with the clock signal embedded therebetween at the single level is transmitted through the single signal line according to the first embodiment of the present invention.

Referring to FIG. 2, the timing controller 100 starts a clock training by transmitting the transmission data (the CED signal) composed of only the clock signal before transmitting the data signals, and then transmits a signal $LOCK_0$ which informs that the clock signal is stabilized, to the data drivers 300. At this time, the transmission data (the CED signal) composed of the single level signal is constructed by inserting the clock signal between the data signals at the same level and then inserting a dummy signal between the data signal and the clock signal to present a rising edge or a falling edge as the transition timing of the inserted clock signal.

The data drivers 300 recover the received clock signal which is to be used for data sampling, depending upon the CED signal transmitted during the clock training interval after the LOCK signal received from the timing controller 100 or adjoining data drivers 300 is in an "H" state (a logic high state). If the received clock signal is stabilized, LOCK signals $LOCK_1$ through $LOCK_N$ (N is a positive integer that indicates the number of the data drivers 300) are outputted as the "H" state. That is to say, after the data drivers 300 receive the LOCK signal $LOCK_0$ of the "H" state informing that the clock signal is stabilized, from the timing controller 100, when the received clock signal is stabilized, the data drivers 300 sequentially output the LOCK signals $LOCK_1$ through $LOCK_{N-1}$ of the "H" state to next data drivers 300. Finally, the timing controller 100, which has received the LOCK signal $LOCK_N$ of the "H" state from the data driver 300, ends the clock training after the lapse of a predetermined time and starts the transmission of the data signals with the clock signal embedded therebetween.

While it is shown in FIGS. 1 and 2 that the data drivers 300 comprise first through eighth data drivers D-IC1 through D-IC8, it is to be noted that data drivers according to the present invention are not limited to such a number and can be provided to various numbers depending upon the size of a display panel.

The monitoring unit includes a sequential transmission section 410 which sequentially connects the data drivers 300 with one another such that the data drivers 300 can transmit their respective state information to other adjoining data drivers 300, and which connects the finally positioned data driver 300 to the timing controller 100 such that the finally positioned data driver 300 can transmit and feed back the state information thereof to the timing controller 100.

Accordingly, if at least one data driver 300 is in an abnormal state due to electromagnetic interference (EMI) or noise while the data received from the timing controller 100 is transmitted to the display panel, the corresponding data driver 300 inactivates the LOCK signal and outputs the LOCK signal of an "L" state (a logic low state) to another adjoining data driver 300.

If the LOCK signal, which is transmitted from at least one data driver 300 to another adjoining data driver 300, is in the "L" state in this way, the LOCK signal which is outputted from the another data driver 300 also has the "L" state. Therefore, if the LOCK signal $LOCK_8$ of the "L" state is inputted from the final data driver D-IC8 to the timing controller 100, the timing controller 100 immediately interrupts the transmission of the CED signal, and starts and implements the clock training until the LOCK signal $LOCK_8$ which is fed back from the final data driver D-IC8 is again in the "H" state, thereby stabilizing the receivers of the data drivers 300.

If the LOCK signal is activated again to the "H" state in this way, the timing controller 100 ends the clock training after the lapse of the predetermined time and transmits again the CED signal as the transmission data to the data drivers 300.

Therefore, since the LOCK signal transmitted between adjoining data drivers 300 is finally fed back to the timing controller 100 in this way, the changes in the states of the data drivers 300 can be continuously monitored, and if an abnormality occurs in a certain data driver 300, the corresponding data driver 300 can be quickly recovered to the normal state.

Figure 3:
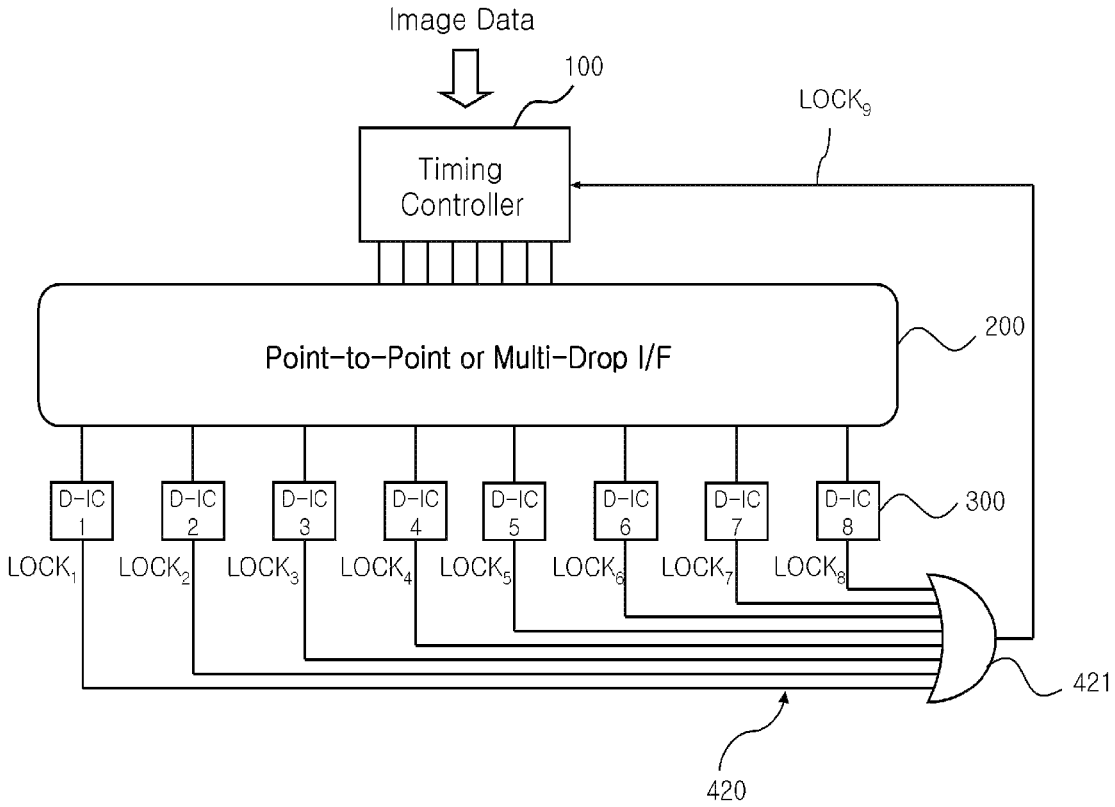
FIG. 3 is a block diagram illustrating a display driving system with a unit for monitoring data drivers in accordance with a second embodiment of the present invention.

FIG. 3 is a block diagram illustrating a display driving system with a unit for monitoring data drivers in accordance with a second embodiment of the present invention.

Referring to FIG. 3, a display driving system with a unit for monitoring data drivers in accordance with a second embodiment of the present invention includes a timing controller 100 configured to receive a data signal and generate and transmit a control signal such as a clock signal, an interface 200 configured to transmit the data signal and the control signal to a plurality of data drivers, the data drivers 300 configured to supply the data signal and the control signal to a display panel to display an image, and a monitoring unit configured to feed back the state information of the data drivers 300 to the timing controller 100.

The timing controller 100 is configured not to embed a clock signal between data signals and transmit the data signal and the clock signal to respective data drivers 300 by way of a multi-drop transmission type interface or a PPDS (point-to-point differential signaling) transmission type interface. The interface 200 according to the present invention is not limited to such types of interfaces and can of course be configured to transmit transmission data in which a clock signal is embedded between data signals at a single level.

The monitoring unit includes a LOCK signal output section 420 which independently outputs LOCK signals indicative of the state information of the plurality of respective data drivers 300, and a logic gate 421 which combines the plurality of LOCK signals outputted from the plurality of data drivers 300, executes a logical operation and outputs a resultant signal. At this time, it is of course that the output terminal of the logic gate 421 must be connected to the timing controller 100 so as to transmit and thereby feed back a state information signal $LOCK_9$ from the data drivers 300, which is obtained by combining the LOCK signals, to the timing controller 100.

As in the aforementioned embodiment, the LOCK signals $LOCK_1$ through $LOCK_8$ outputted from the data drivers 300 and transmitted to the LOCK signal output section 420 are in the logic high (H) state as an activated state when the data drivers 300 are in normal states, and are in the logic low (L) state as an inactivated state when at least one of the data drivers 300 is in an abnormal state.

It is preferred that the logic gate 421 comprise an OR gate which outputs a logic low state when even any one input is in a logic low state, so that, when even any one of the plurality of LOCK signals $LOCK_1$ through $LOCK_8$ outputted from the data drivers 300 is in an inactivated state, the corresponding state change can be transmitted to the timing controller 100.

In this way, if the LOCK signal from at least one data driver 300 is in the inactivated state, the receiver of the corresponding data driver 300 indicates the abnormal state, and the data driver 300 is configured to neglect the data signals continuously inputted thereto through the interface 200 and drive the display panel using previously inputted data.

The timing controller 100, which recognizes the abnormal state of the data driver 300 from the LOCK signal transmitted from the logic gate 421, transmits a preamble signal as deskewing data between the data signal and the clock signal or a clock training signal for the recovery of the clock signal, to the data driver 300 after the lapse of a preset time so as to wait until the LOCK signals of all the data drivers 300 represent the logic high (H) state indicating the activated state.

Figure 4:
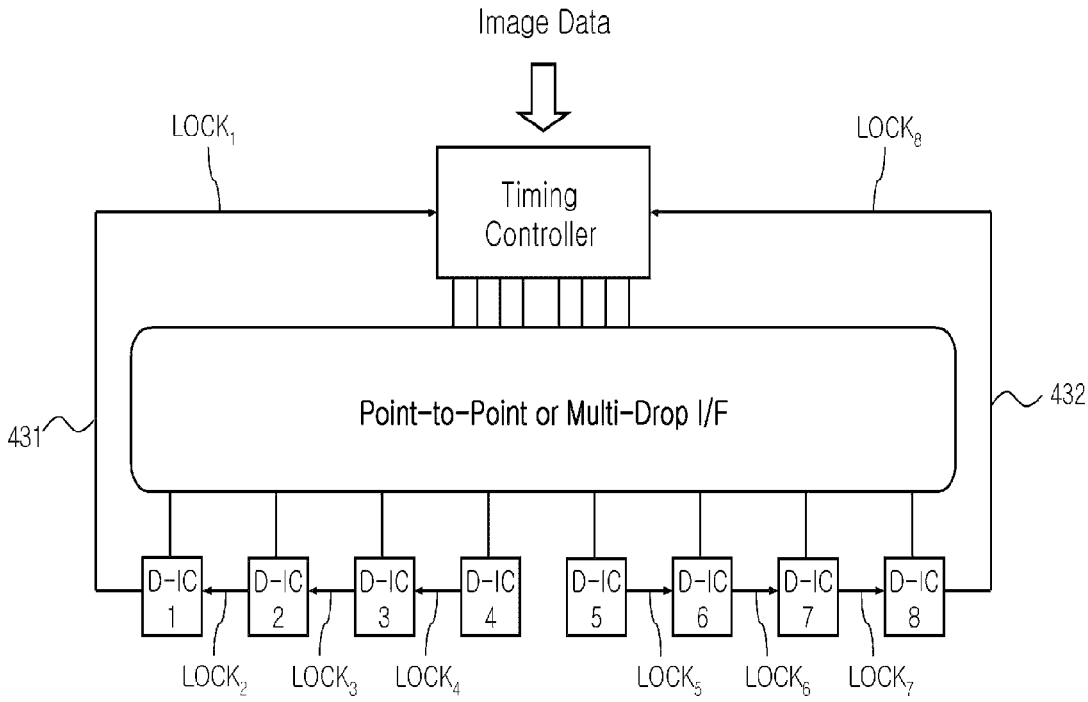
FIG. 4 is a block diagram illustrating a display driving system with a unit for monitoring data drivers in accordance with a third embodiment of the present invention.

FIG. 4 is a block diagram illustrating a display driving system with a unit for monitoring data drivers in accordance with a third embodiment of the present invention.

Referring to FIG. 4, a display driving system with a unit for monitoring data drivers in accordance with a third embodiment of the present invention includes a timing controller 100 configured to receive a data signal and generate and transmit a control signal such as a clock signal, an interface 200 configured to transmit the data signal and the control signal to a plurality of data drivers, the data drivers 300 configured to supply the data signal and the control signal to a display panel to display an image, and a monitoring unit configured to feed back the state information of the data drivers 300 to the timing controller 100.

Because the timing controller 100, the interface 200 and the data drivers 300 are the same as those of the first and second embodiments, only the configuration of the monitoring unit will be mainly described below.

The monitoring unit includes first through $N^{th}$ sequential transmission sections which are configured to divide the plurality of data drivers 300 into N (N is a natural number identical to or greater than 1) number of groups each of which is composed of one or more data drivers 300, and connect the data drivers of the respective groups with one another in such a way as to sequentially transmit LOCK signals to adjoining data drivers 300, wherein the last data drivers of the respective groups which receive the LOCK signals are connected to the timing controller 100 such that the LOCK signals of the respective groups can be transmitted and fed back to the timing controller 100.

While it is illustrated in FIG. 4 that the monitoring unit includes the first sequential transmission section and the second sequential transmission section, it is to be understood that the monitoring unit is not limited to the number of sequential transmission sections and may include the first through $N^{th}$ sequential transmission sections depending upon the number of the data drivers.

Referring to FIG. 4, the monitoring unit is configured to sequentially connect the data drivers with one another such that the data drivers 300 can transmit the state information thereof to other adjoining data drivers 300. The monitoring unit includes a first sequential transmission section 431 which sequentially transmits state information from one data driver 300 disposed at a substantial middle position to other adjoining data drivers 300 in one direction and a second sequential transmission section 432 which transmits state information from another data driver 300 disposed at another substantial middle position to other adjoining data drivers 300 in another direction.

The data driver D-IC1, which is disposed last in the direction of the first sequential transmission section 431, is configured to transmit the state information thereof to the timing controller 100, and the data driver I-IC8, which is disposed last in the direction of the second sequential transmission section 432, is also configured to transmit the state information thereof to the timing controller 100.

Hence, as shown in FIG. 4, in the first sequential transmission section 431, a plurality of data drivers D-IC4, D-IC3, D-IC2 and D-IC1 are connected like a chain to transmit state information in the direction that extends from the fourth data driver D-IC4 disposed at the substantial middle position toward the first data driver D-IC1, and the first data driver D-IC1 disposed last in the direction is connected to the timing controller 100. In the second sequential transmission section 432, a plurality of data drivers D-IC5, D-IC6, D-IC7 and D-IC8 are connected like a chain to transmit state information in the direction that extends from the fifth data driver D-IC5 disposed at another substantial middle position toward the eighth data driver D-IC8, and the eighth data driver D-IC8 disposed last in the direction is connected to the timing controller 100.

The respective data drivers 300 output the LOCK signals of an "H" state (a logic high state) to other adjoining data drivers 300 in normal states, and outputs the LOCK signals of an "L" state (a logic low state) to other adjoining data drivers 300 in abnormal states. When the LOCK signals received from the adjoining data drivers 300 are in the "L" state, the respective following data drivers 300 output the "L" state irrespective of their states.

Accordingly, if the LOCK signal $LOCK_1$ changed to the "L" state is inputted from the last data driver D-IC1 of the first sequential transmission section 431 to the timing controller 100 or the LOCK signal $LOCK_8$ changed to the "L" state is inputted from the last data driver D-IC8 of the second sequential transmission section 432 to the timing controller 100, the timing controller 100 immediately interrupts the transmission of a CED signal, and starts and implements a clock training until the fed-back LOCK signals $LOCK_1$ and $LOCK_8$ are recovered to the "H" state, thereby stabilizing the receivers of the data drivers 300. At this time, since the timing controller 100 can grasp the position of a data driver 300 which is in the abnormal state, from the fed-back signal, the corresponding data driver 300 can be quickly recovered to the normal state.

Figure 5:
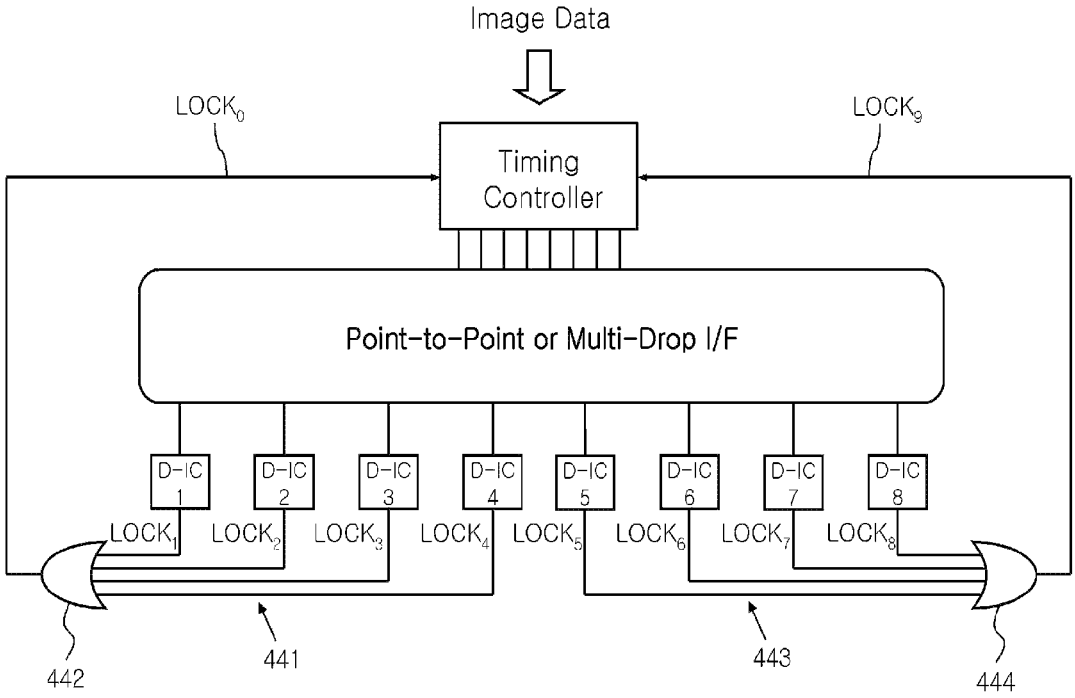
FIG. 5 is a block diagram illustrating a display driving system with a unit for monitoring data drivers in accordance with a fourth embodiment of the present invention.

FIG. 5 is a block diagram illustrating a display driving system with a unit for monitoring data drivers in accordance with a fourth embodiment of the present invention.

Referring to FIG. 5, a display driving system with a unit for monitoring data drivers in accordance with a fourth embodiment of the present invention includes a timing controller 100 configured to receive a data signal and generate and transmit a control signal such as a clock signal, an interface 200 configured to transmit the data signal and the control signal to a plurality of data drivers, the data drivers 300 configured to supply the data signal and the control signal to a display panel to display an image, and a monitoring unit configured to feed back the state information of the data drivers 300 to the timing controller 100.

Because the timing controller 100, the interface 200 and the data drivers 300 are the same as those of the first, second and third embodiments, only the configuration of the monitoring unit will be mainly described below.

The monitoring unit includes first through $M^{th}$ LOCK signal output sections which are configured to divide the plurality of data drivers 300 into M (M is a natural number identical to or greater than 1) number of groups each of which is composed of one or more data drivers 300, and transmit independently the LOCK signals outputted from the data drivers constituting the respective groups to logic gates, and first through $M^{th}$ logic gates which are configured to receive the LOCK signals transmitted from the respective groups of the first through $M^{th}$ LOCK signal output sections, execute logical operations, and feed back output values thereof to the timing controller 100.

While it is illustrated in FIG. 5 that the monitoring unit includes the first LOCK signal output section, the second LOCK signal output section, the first logic gate and the second logic gate, it is to be understood that the monitoring unit is not limited to the number of LOCK signal output sections and the number of logic gates and that LOCK signal output sections may comprise the first through $M^{th}$ LOCK signal output sections depending upon the number of the data drivers and logic gates for receiving the signals transmitted from the respective LOCK signal output sections may comprise the first through $M^{th}$ logic gates.

Referring to FIG. 5, the monitoring unit includes first and second LOCK signal output sections 441 and 443 which respectively and independently output state information from plural numbers of data drivers 300, a first logic gate 442 which combines the plurality of LOCK signals outputted from the plural number of data drivers 300 through the first LOCK signal output section 441, executes a logical operation and transmits an output value $LOCK_0$ to the timing controller 100, and a second logic gate 444 which combines the plurality of LOCK signals outputted from the plural number of data drivers 300 through the second LOCK signal output section 443, executes a logical operation and transmits an output value $LOCK_9$ to the timing controller 100.

In the fourth embodiment, as shown in FIG. 5, when assuming that total eight data drivers 300 are provided, the first logic gate 442 is configured to receive the LOCK signals outputted from the first through fourth data drivers D-IC1, D-IC2, D-IC3 and D-IC4, and the second logic gate 444 is configured to receive the LOCK signals outputted from the fifth through eighth data drivers D-IC5, D-IC6, D-IC7 and D-IC8. In this way, it is preferred that the first and second logic gates 442 and 444 be configured to be connected to the plurality of data drivers 300 in order to equally receive the LOCK signals outputted from the plurality of data drivers 300.

The LOCK signals $LOCK_1$ through $LOCK_4$ outputted from respective data drivers 300 and transmitted to the first LOCK signal output section 441 and the LOCK signals $LOCK_5$ through $LOCK_8$ outputted from respective data drivers 300 and transmitted to the second LOCK signal output section 443 represent a logic high (H) state as an activated state when the data drivers 300 are in normal states and represent a logic low (L) state as an inactivated state when at least one of the data drivers 300 is in an abnormal state.

It is preferred that the first logic gate 442 comprise an OR gate which executes a logical operation such that, when even any one of the plurality of LOCK signals $LOCK_1$ through $LOCK_4$ outputted from the corresponding data drivers 300 represents the inactivated state, the first logic gate 442 can transmit the signal $LOCK_0$ indicating the stage change to the timing controller 100, and that the second logic gate 444 comprise an OR gate which executes a logical operation such that, when even any one of the plurality of LOCK signals $LOCK_5$ through $LOCK_8$ outputted from the corresponding data drivers 300 represents the inactivated state, the second logic gate 444 can transmit the signal $LOCK_0$ indicating the stage change to the timing controller 100.

When the LOCK signal of at least one data driver 300 represents the inactivated state, since the receiver of the corresponding data driver 300 is in the abnormal state, the data driver 300 is configured to neglect the data signals which are continuously inputted thereto through the interface 200 and drive the display panel using previously inputted data.

Due to the fact that logic gates for receiving the LOCK signals transmitted from the plurality of data drivers 300 as signals indicative of state information and then executing logical operations are provided in a plural number, the logical operations can be quickly executed, and since the timing controller can easily grasp the approximate position of the data driver 300 which has a problem, it is possible to deal with the abnormal state of the data driver 300.

Figure 6:
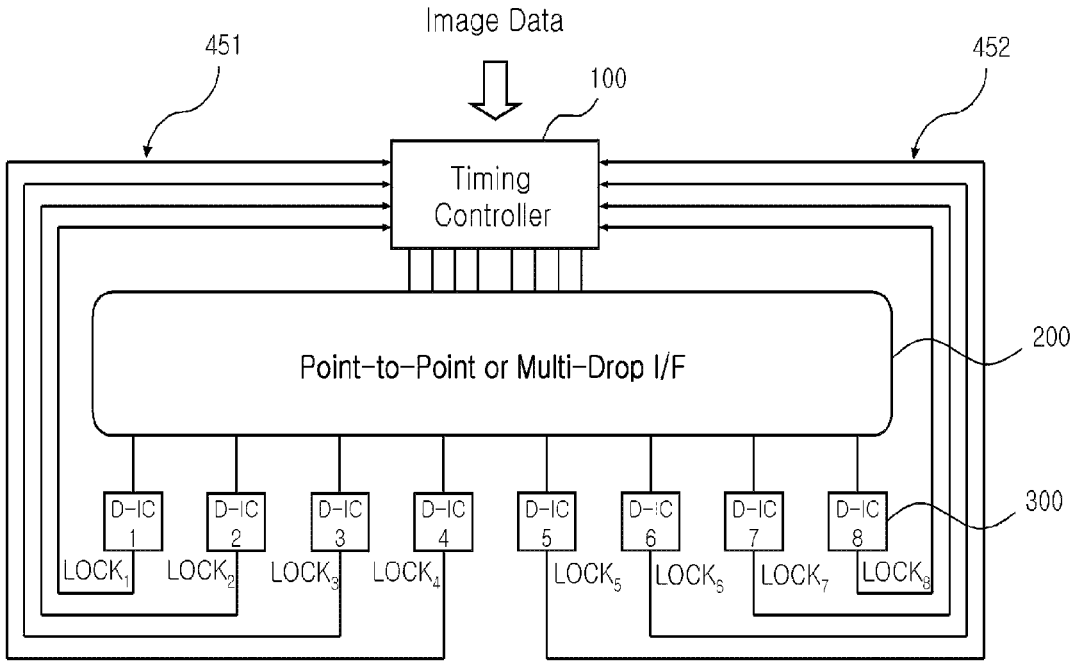
FIG. 6 is a block diagram illustrating a display driving system with a unit for monitoring data drivers in accordance with a fifth embodiment of the present invention.

FIG. 6 is a block diagram illustrating a display driving system with a unit for monitoring data drivers in accordance with a fifth embodiment of the present invention.

Referring to FIG. 6, a display driving system with a unit for monitoring data drivers in accordance with a fifth embodiment of the present invention includes a timing controller 100 configured to receive a data signal and generate and transmit a control signal such as a clock signal, an interface 200 configured to transmit the data signal and the control signal to a plurality of data drivers, the data drivers 300 configured to supply the data signal and the control signal to a display panel to display an image, and a monitoring unit configured to feed back the state information of the data drivers 300 to the timing controller 100.

Because the timing controller 100, the interface 200 and the data drivers 300 are the same as those of the first through fourth embodiments, only the configuration of the monitoring unit will be mainly described below. Further, the interface 200 can be configured to transmit the data signal and the clock signal to the respective data drivers 300 according to a multi-drop transmission scheme or a point-to-point differential signaling transmission scheme or to transmit transmission data in which a clock signal is embedded between data signals at a single level, to the data drivers 300.

The monitoring unit includes independent feed-back sections 451 and 452 which are configured to independently output LOCK signals indicative of state information of the plurality of data drivers 300 and feed back the LOCK signals to the timing controller 100 through independent transmission lines connected between the respective data drivers 300 and the timing controller 100.

Similar to the first through fourth embodiments, LOCK signals $LOCK_1$ through $LOCK_8$ outputted from the plurality of data drivers 300 have a logic high (H) state indicating an activated state when the data drivers 300 are in normal states and a logic low (L) state indicating an inactivated state when at least one of the data drivers 300 is in an abnormal state.

Thus, if at least one of the LOCK signals transmitted through the independent feed back sections 451 and 452 is inactivated, the timing controller 100 can immediately recognize that the receiver of the corresponding data driver 300 is in an abnormal state. Then, the corresponding data driver 300 neglects the data signals continuously inputted thereto through the interface 200 and drives the display panel using previously inputted data. The timing controller 100, which has recognized the abnormal state of the data driver 300 through the independent feed back sections 451 and 452, transmits a preamble signal as deskewing data.

As described above, in the present invention, differently from the conventional art in which data drivers simply receive data signals, etc. from a timing controller, respective data drivers sequentially transmit LOCK signals indicating the states thereof to adjoining data drivers and then finally to a timing controller, LOCK signals outputted from respective data drivers are combined by at least one logic gate and then transmitted to a timing controller, or LOCK signals of respective data drivers are transmitted to a timing controller through independent feed back sections. As a consequence, the timing controller can recognize a change in the states of the data drivers and can quickly take necessary measures such as by transmitting appropriate data or control signal.

As is apparent from the above description, the display driving system with a unit for monitoring data drivers according to the present invention renders advantages in that the monitoring unit is provided to feed back a LOCK signal indicative of a change in the state of a data driver to a timing controller so that the state of the data driver can be monitored, and the timing controller having recognized the state of the data driver can transmit a data signal and a control signal appropriate for normalizing the data driver operating in an abnormal state so that the data driver can be quickly recovered to a normal operation.

Although preferred embodiments of the present invention have been described for illustrative purposes, those skilled in the art will appreciate that various modifications, additions and substitutions are possible, without departing from the scope and the spirit of the invention as disclosed in the accompanying claims.

What is claimed is:

1. A display driving system comprising:

a timing controller configured to receive a data signal composed of image data and generate a control signal such as a clock signal;

an interface configured to transmit the data signal and the control signal to a plurality of data drivers;

the data drivers configured to receive the data signal and the control signal through the interface and supply received signals to a display panel to display an image; and a monitoring unit configured to feed back one or more LOCK signals indicative of state information of one or more of the data drivers to the timing controller such that the data drivers can be monitored, wherein when a first data driver from the plurality of data drivers is in an abnormal state due to electromagnetic interference (EMI) or noise, the first data driver outputs a first LOCK signal indicating that the first data driver is in the abnormal state.

2. The display driving system according to claim 1, wherein the monitoring unit comprises a sequential transmission section which sequentially connects the data drivers with one another such that the data drivers can sequentially transmit the LOCK signals indicating their respective state information to other adjoining data drivers, and which connects a finally positioned data driver to the timing controller such that the finally positioned data driver can feed back a LOCK signal to the timing controller.

3. The display driving system according to claim 1, wherein the monitoring unit comprises first through $N^{th}$ sequential transmission sections which are configured to divide the plurality of data drivers into N (N is a natural number identical to or greater than 1) number of groups each of which is composed of one or more data drivers, and connect the data drivers of the respective groups with one another in such a way as to sequentially transmit the LOCK signals to adjoining data drivers, such that last data drivers of the respective groups which receive the LOCK signals are connected to the timing controller so that the LOCK signals of the respective groups can be transmitted and fed back to the timing controller.

4. The display driving system according to claim 3, wherein, if a LOCK signal indicating that one or more of the data drivers is in an abnormal state is inputted to the timing controller, the timing controller interrupts transmission of the data signal, and implements a clock training until the timing controller receives a fed-back signal indicating that the data drivers are in a normal state, thereby stabilizing the data drivers.

5. The display driving system according to claim 1, wherein, if a LOCK signal indicating that one or more of the data drivers is in an abnormal state is inputted to the timing controller, the timing controller interrupts transmission of the data signal, and implements a clock training until the timing controller receives a fed-back signal indicating that the data drivers are in a normal state, thereby stabilizing the data drivers.

6. The display driving system according to claim 1, wherein the monitoring unit comprises a LOCK signal output section which independently transmits the LOCK signals outputted from the plurality of data drivers to a logic gate, and the logic gate which is connected to the timing controller, combines one or more LOCK signals outputted from the LOCK signal output section, executes a logical operation and outputs a resultant signal to the timing controller.

7. The display driving system according to claim 6, wherein, if the first LOCK signal is outputted from the first data driver, the first data driver neglects the data signal transmitted through the interface and drives the display panel using previously inputted data; and wherein the timing controller is configured to transmit a preamble signal as deskewing data between the data signal and the clock signal or a clock training signal for recovery of the clock signal, to the first data driver until a second LOCK signal indicating that the first data driver is in a normal state is fed back.

8. The display driving system according to claim 1, wherein the monitoring unit comprises first through $M^{th}$ LOCK signal output sections which are configured to divide the plurality of data drivers into M (M is a natural number identical to or greater than 1) number of groups each of which is composed of one or more data drivers, and transmit independently the LOCK signals outputted from the data drivers constituting the respective groups to logic gates, and first through $M^{th}$ logic gates which are configured to receive the LOCK signals transmitted from the respective groups of the first through $M^{th}$ LOCK signal output sections, execute logical operations, and feed back output values thereof to the timing controller.

9. The display driving system according to claim 8, wherein, if the first LOCK signal is outputted from the first data driver, the first data driver neglects the data signal transmitted through the interface and drives the display panel using previously inputted data; and wherein the timing controller is configured to transmit a preamble signal as deskewing data between the data signal and the clock signal or a clock training signal for recovery of the clock signal, to the first data driver until a second LOCK signal indicating that the first data driver is in a normal state is fed back.

10. The display driving system according to claim 1, wherein the monitoring unit comprises independent feedback sections which are configured to independently output the LOCK signals indicative of state information of the plurality of data drivers and feed back the LOCK signals to the timing controller through independent transmission lines connected between the respective data drivers and the timing controller.

11. The display driving system according to claim 10, wherein, if the first LOCK signal is outputted from the first data driver, the first data driver neglects the data signal transmitted through the interface and drives the display panel using previously inputted data; and wherein the timing controller is configured to transmit a preamble signal as deskewing data between the data signal and the clock signal or a clock training signal for recovery of the clock signal, to the first data driver until a second LOCK signal indicating that the first data driver is in a normal state is fed back.

12. The display driving system according to claim 1, wherein the first LOCK signal is in a logic low state.

13. The display driving system according to claim 1, wherein when the first data driver is in the abnormal state, the first data driver inactivates and the first LOCK signal indicates that the first data driver is in an inactivated state.

14. The display driving system according to claim 13, wherein when the first data driver is in the abnormal state, a second data driver from the plurality of data drivers inactivates and outputs a LOCK signal indicating that the second data driver is in an inactivated state.

* * * * *